US005670021A

United States Patent [19]

Owens

[11] Patent Number: 5,670,021

[45] Date of Patent: Sep. 23, 1997

[54] PROCESS FOR PRODUCTION OF PAPER

[75] Inventor: Michael Owens, Wyee Point, Australia

[73] Assignee: Kemira Kemi Aktiebolag, Helsingborg, Sweden

[21] Appl. No.: 256,858

[22] PCT Filed: Jan. 28, 1993

[86] PCT No.: PCT/SE93/00063

§ 371 Date: Oct. 31, 1994

§ 102(e) Date: Oct. 31, 1994

[87] PCT Pub. No.: WO93/15271

PCT Pub. Date: Aug. 5, 1993

[51] Int. Cl.[6] ..... D21H 21/10; D21H 17/14

[52] U.S. Cl. ..... 162/164.1; 162/164.3; 162/168.7; 162/181.7; 162/183

[58] Field of Search ..... 162/158, 164.1, 162/164.4, 165, 168.1, 169, 180, 181.6, 164.3, 168.7, 181.7, 183, 164.5; 210/727, 728, 731, 732, 928

[56] References Cited

U.S. PATENT DOCUMENTS

| | | | |
|---|---|---|---|
| 4,070,236 | 1/1978 | Carrard et al. | 162/164.1 |
| 4,313,790 | 2/1982 | Pelton et al. | 162/163 |
| 4,927,498 | 5/1990 | Rushmere | 162/168.3 |
| 4,954,220 | 9/1990 | Rushmere | 162/168.3 |
| 5,098,520 | 3/1992 | Begala | 162/168.1 |
| 5,173,208 | 12/1992 | Chung et al. | 252/180 |

FOREIGN PATENT DOCUMENTS

| | | | |
|---|---|---|---|
| 1004782 | 2/1977 | Canada | 362/48 |
| 3241495 | 7/1984 | Germany . | |
| 1-183599 | 7/1989 | Japan | D21H 3/50 |
| 454507 | 5/1988 | Sweden . | |
| 1364745 | 8/1972 | United Kingdom | D21H 1/38 |

OTHER PUBLICATIONS

Leung et al. "Flocculation of paper fines by polyethyleneoxide", Tappi Journal, vol. 70, No. 7, pp. 115–118 Jul. 1987.

Pelton et al., "Novel dual-polymer retention aids for newsprint and groundwood specialties", Tappi Journal, vol. 64, No. 11, pp. 89–92 Nov. 1981.

Braun et al., "Filler and fiber retention in newsprint and groundwood specialties using poly(ethylen-oxide)", Tappi Journal, vol. 67, No. 9, pp. 110–114.

Tay, "Appliction of polymeric flocculant in newsprint stock system for fines retention improvement", Tappi Journal, vol. 63, No. 6, pp. 63–66 Jun. 1980.

Wegner, "The effects of polymeric additive on papermaking", Tappi Journal, vol. 70, No. 7, pp. 107–111 Jul. 1987.

Pelton, et al., "A survey of potential retention aids for newsprint manufacture", Pulp & Paper, vol. 81, No. 1, pp. 54–62 Jan. 1980.

*Primary Examiner*—Donald E. Czaja
*Assistant Examiner*—Jose A. Fortuna
*Attorney, Agent, or Firm*—Brumbaugh, Graves, Donohue & Raymond

[57] ABSTRACT

A process for the production of paper by forming and dewatering a suspension of cellulose containing fibers and optional fillers and cationic starch on a wire or fabric, characterized in that the forming and dewatering takes place in the presence of an alkali metal silicate and a phenolic resin added at the same point into the suspension, and polyethylene oxide added at a subsequent point into the suspension. The amount of alkali metal silicate is 0.1 kg per ton to 50 kg/ton based on silica content per ton of dry fibers. The amount of phenolic resin is 0.01 kg/ton to 5 kg/ton based on weight of resin in the as-supplied material per ton of dry fibers. The amount of polyethylene oxide is 0.01 to 2.0 kg/ton based on weight of polyethylene oxide per ton of dry fibers.

10 Claims, No Drawings

PROCESS FOR PRODUCTION OF PAPER

FIELD OF THE INVENTION

The present invention relates to papermaking, particularly to a method whereby a suspension of pulp, containing optional filler and cationic starch, is spread over a wire or cloth and the water is removed to form a fibre web or sheet. More particularly the invention relates to the use of a special combination of phenolic resin, alkali metal silicate and polyethylene oxide, with the above-mentioned paper furnish components. The purpose of this special combination which is described in this invention is to provide a flocculation process leading to improved retention of fines in the paper sheet, improved drainage and drying properties and consequent increases in recovery and production rate whilst also maintaining good sheet quality.

BACKGROUND AND SUMMARY OF INVENTION

The prior art contains many examples of chemical systems to improve retention and drainage in the production of paper and paperboard. These systems include the combination of phenolic resin and polyethylene oxide which has been particularly successful for newsprint applications, where mechanical pulp containing dissolved organic contaminants causes detrimental effects to other retention treatments. Phenolic resin is usually added first, before the last shear zone, such as a fan pump, and polyethylene oxide is added second, usually near the headbox in order to minimise shear. It has been proposed that the mechanism of this two-component systems consists firstly of adsorption of the phenolic resin onto fibres and fines, followed by attachment of polyethylene oxide to the phenolic hydroxyl groups of the resin, forming high molecular weight polymeric networks which serve to retain the fines and also promote drainage.

The above system is independent of most dissolved and colloidal contaminants in the water circuit because it functions by a hydrogen-bonding mechanism. In contrast, commonly-used cationic polyacrylamides are adversely affected by many dissolved and colloidal organic contaminants in mechanical pulp from species such as Radiata pine used in many newsprint mills. Consequently, the phenolic resin/polyethylene oxide system has been adopted in many newsprint mills in recent years. This system has several other advantages including more favourable effects on the final sheet formation than some other retention systems. It has also been demonstrated that fillers such as kaolin can actually assist the overall retention and drainage if they are premixed with the phenolic resin prior to addition to the stock, and then the polyethylene oxide is added. Another advantage of the phenolic resin/polyethylene oxide combination is pitch control which refers to its ability to fix organic contaminants in the paper sheet rather than allowing them to deposit on the mill fabrics and machinery and cause eventual shutdowns.

Nevertheless, despite the above advantages, this retention and drainage system has not been adopted in other mills producing grades such as fine paper, tissue and packaging papers, where mechanical pulp from softwood does not form a large part of the furnish. In these areas, cationic polyacrylamides are the predominant treatment. There are also some recent two component processes, including the combination of cationic polymer and bentonite (AU-B-68118/87) and the combination of cationic polymer and colloidal silica or modified polysilicic acid, as described scribed in AU-B-34970/89, AU-B-37345/89 and AU-B-41363/89.

The main reason for the lack of success of the phenolic resin/polyethylene oxide system in the above areas is the reduced performance owing to the lack of organic contaminants in these furnishes compared to the softwood mechanical pulp used in many newsprint applications. These contaminants provide a part of the network mechanism by which this retention system functions and their absence in other furnishes such as sulphate pulp and recycled and deinked pulp has led to the predominance of other retention systems, especially cationic polyacrylamides. In addition it has been found that residual silicate in the pulp from some bleaching and de-inking operations sometimes has an adverse effect on polyethylene oxide causing a loss of retention or drainage. Rahman and Tay (Tappi Proceedings, 1986 Papermakers Conference, p 189–198) discuss this effect.

The present invention discloses a surprising synergism between alkali metal silicate and phenol formaldehyde resin, when used in conjunction with polyethylene oxide. When the silicate and phenolic resin are added to a paper stock at close positions or, preferably, are premixed before addition to the stock, they form a structure which gives a remarkably improved reaction with polyethylene oxide when it is subsequently added to the stock. Retention (as fiber retention, filler retention, and COD-retention (natural resins and other organic contaminants)) and drainage are significantly improved, to the extent that the above areas of fine paper, recycle packaging grades and other types of paper production become viable areas for this system to be used. All previous references in the prior art have discussed silicate as a detrimental additive in its reaction with polyethylene oxide. None has described silicate as a deliberate component of the phenolic resin/polyethylene oxide retention system. Previous references to silicate in retention systems have described the prior conversion to colloidal silica or polysilicic acid before it is dosed into a paper stock. This invention discloses the use of the soluble metal silicate in alkaline form, with no conversion to colloidal form prior to mixing with phenolic resin. It has been found that the detention time after mixing of silicate and resin can be a few seconds to many days, the preferable detention time being 10 minutes or longer. The combined phenolic resin and silicate enters the stock as an alkaline solution which may have formed a dissolved polymeric structure, as yet undetermined. This structure reacts more favourably with polyethylene oxide than any previous combination. Moreover, it reacts much more favourably with polyethylene oxide than either phenolic resin or silicate on its own. That is, a powerful synergism occurs when phenolic resin and alkali metal silicate are combined.

The alkali metal silicate generally used has been sodium metasilicate pentahydrate containing approximately 30 percent silica, 30 percent sodium oxide and 40 percent water. Other sodium silicates include the disilicate, orthosilicate and water glass. These and other silicates of the alkali metals are included in the scope of the present invention. In certain circumstances the alkali metal silicate can be replaced by sodium aluminate. The amount of silicate required is in the range of 0.1 kg/tonne to 50 kg/t based on dry silica content per tonne of dry fibres. The amount of phenolic resin required is 0.01 kg/tonne to 5 kg/tonne based on actual phenolic resin content in the as-supplied material. The amount of polyethylene oxide required is in the range 0.01 kg/tonne to 2 kg/tonne. The preferable ranges of the above components are 2–20 kg/tonne of the silicate (as silica). The amount of silica calculated on dry matter should preferably be less than 1.6%. 0.1–2.0 kg/tonne of the phenolic resin and 0.03–0.30 kg/tonne of polyethylene oxide. The ratio of silica to phenolic resin is in the range 1:0.1 to 1:10, and is preferably 1:0.2 to 1:5, more preferably 1:0.5 to 1:2. The ratio of phenolic resin to polyethylene oxide added is about 5–10:1, whereby the ratio alkali metal silicate to polyethylene oxide should be <40:1. The phenolic resin/silicate combination is dosed into the stock at a region of good mixing, such as fan pump, and the polyethylene oxide is dosed into the stock further downstream, preferably near the headbox.

Further improvements have been observed with polyethylene oxide when filler is pretreated with the silicate/phenolic resin solution before it is added to the stock. As previously mentioned phenolic resin plus filler has given substantial improvement with polyethylene oxide in prior art disclosures, the premixing of resin and filler constituting an important step as a non flocculating pre-treatment. This invention discloses a further significant improvement when the filler is pretreated with the mixture of phenolic resin and alkali metal silicate. This type of pretreatment is also non-flocculating and thus allows better dispersion of filler throughout the stock than a flocculating pretreatment, and better opacifying properties. The pretreated filler is dosed into the stock before the last point of shear, and the polyethylene oxide is dosed preferably near the headbox thus capturing the filler particles as well as other fines and fibres in an apparent network structure. This structure appears to be dramatically improved by the combination of phenolic resin and alkali metal silicate.

It is also disclosed in this invention that a synergistic reaction has also been found, with phenolic resin and cationic starch, when they are premixed and then dosed into paper stock followed by polyethylene oxide addition.

Furthermore, when silicate and phenolic resin are premixed and are then added to cationic starch before it is dosed into the stock, the reaction with polyethylene oxide is further enhanced. This system provides a means of retaining starch as well as further improving overall retention and drainage. Other papermaking starches have also shown improvement with this system.

Thus this invention utilises the synergism between phenolic resin and alkali metal silicate to enhance the performance with polyethylene oxide and to allow the use of polyethylene oxide and phenolic resin in a wider range of applications than at present, as well as improving the existing newsprint applications. Furthermore, the synergistic phenolic resin/alkali metal silicate combination gives further benefits if it is premixed with filler and/or cationic starch prior to dosing into the stock and reaction with polyethylene oxide. These affects have been confirmed with acidic and neutral furnishes and a variety of fillers including kaolin, calcite, bentonite and titanium dioxide. The practice of this invention would enable the benefits of polyethylene oxide to be realised in more applications than at present. These benefits include a more favourable sheet formation than polyacrylamide retention agents, an ability to fix pitch contaminants in the sheet and the generally lower dosage rate than polyacrylamide systems, leading to possibly lower steam consumption in the driers because of the smaller amount of bound water. The improved formation mentioned above is probably partly due to the lower polymer dosage achieved with polyethylene oxide.

Other benefits shown by the practice of this invention are its favourable reaction with starch, and its ability to provide a superior non-flocculating pretreatment of filler in order that the activated filler is more fully dispersed throughout the stock prior to its capture by the addition of the polyethylene oxide component. The provision of a superior non-flocculating pretreatment of filler allows the filler to attain its best opacifying power while at the same time the capture by polyethylene oxide ensures good filler retention.

The present invention will be illustrated by the following examples, however, without being restricted hereto.

EXAMPLE 1

A 1% cellulosic fibre slurry consisting of 100% TMP (thermo mechanical pulp) was taken from a newsprint mill.

For tests a Dynamic drainage jar (DDJ) was used with a baffled cylinder and the speed of the stirrer was set at 1000 rpm.

The parameter measured was retention. The table below shows the results when conventional phenol formaldehyde resin is compared to "activated" phenol formaldehyde resin, (activated by alkali metal silicate).

The ratio between polyethylene oxide and phenol formaldehyde resin is 1:5 and the ratio between phenol formaldehyde and sodium meta silicate (based on the content of $SiO_2$) is 1:2.

| Polyethylene oxide g/t | Conventional resin retention % | "Activiated resin" retention % |
|---|---|---|
| 150 | 74 | 81 |
| 200 | 76 | 86 |
| 300 | 82 | 89 |
| 400 | 84 | 92 |

EXAMPLE 2

A 1.2% cellulose fibre slurry consisting of 30% filler, 70% RCF (recycled fibres) and 30% TMP was taken from a newsprint mill using recycled fibres.

For tests a Dynamic drainage jar (DDJ) was used with a baffled cylinder and the speed of the stirrer was set at 1000 rpm.

The parameter measured was retention. The table below shows the results when conventional phenol formaldehyde resin is compared to "activated" phenol formaldehyde resin.

The ratio between polyethylene oxide and phenol formaldehyde resin is 1:2 and the ratio between phenol formaldehyde and water glass (based on the content of $SiO_2$) is 1:1.

| Polyethylene oxide g/t | Conventional resin retention % | "Activiated resin" retention % |
|---|---|---|
| 150 | 48 | 53 |
| 200 | 67 | 70 |
| 300 | 72 | 80 |

EXAMPLE 3

A 1% cellulose fibre slurry consisting of 100% TMP was taken from a newsprint mill and diluted down to 0.1%.

To measure the drainage effect a Dynamic drainage analyzer (DDA) was used. The DDA is measuring drainage by monitoring the time for the water mirror to disappear from the filter cake in the jar.

The table below shows the results when conventional phenol formaldehyde resin is compared to "activated" phenol formaldehyde resin.

The ratio between polyethylene oxide and phenol formaldehyde resin is 1:6 and the ratio between phenol formaldehyde and sodium meta silicate (based on the content of $SiO_2$) is 1:2.

| Polyethylene oxide g/t | Conventional resin time (s) | "Activiated resin" time (s) |
|---|---|---|
| 150 | 22 | 18 |
| 200 | 20 | 16 |
| 300 | 17 | 11 |
| 400 | 14 | 10 |

I claim:

1. A process for the production of paper by forming and dewatering of a suspension of cellulose comprising fibers and optional fillers and cationic starch on a wire or fabric, wherein the forming and dewatering takes place in the presence of a non-colloidal alkali metal silicate and a phenolic resin which are contacted together to form a structure which provides improved reactivity with polyethylene oxide compared with both the non-colloidal alkali metal silicate and the phenolic resin alone, wherein the non-colloidal alkali metal silicate and the phenolic resin are added to said suspension before or after contacting them together, and polyethylene oxide is added to said suspension at a subsequent point downstream from where the non-colloidal alkali metal silicate and the phenolic resin are added to the suspension, wherein the polyethylene oxide is added to the suspension upstream of the location of forming and dewatering said suspension.

2. A process according to claim 1 in which the amount of said alkali metal silicate is 0.1 kg per tonne to 50 kg/tonne based on silica content per tonne of dry fibres.

3. A process according to claim 1 in which the amount of said phenolic resin is 0.01 kg/tonne to 5 kg/tonne based on weight of resin in the as-supplied material per tonne of dry fibres.

4. A process according to claim 1 in which the amount of said polyethylene oxide is 0.01–2.0 kg/tonne based on weight of polyethylene oxide per tonne of dry fibers.

5. A process according to claim 1, in which the ratio of alkali metal silicate to phenolic resin is 10:1 to 1:10.

6. A process according to claim 1, in which the ratio of phenolic resin to polyethylene oxide is 5–10:1.

7. A process according to claim 1, in which the ratio of alkali metal silicate to polyethylene oxide is less than 40:1.

8. A process according to claim 1 in which the said phenolic resin and alkali metal silicate are pre-mixed before addition to the suspension and are held in storage for a period of more than 10 minutes.

9. A process according to claim 1 in which said filler is mixed with the combined phenolic resin and alkali metal silicate before addition to the suspension.

10. A process according to claim 1 in which a cationic starch is mixed with the combined phenolic resin and alkali metal silicate before addition to the suspension.

* * * * *

UNITED STATES PATENT AND TRADEMARK OFFICE

CERTIFICATE OF CORRECTION

PATENT NO. : 5,670,021

DATED : September 23, 1997

INVENTOR(S) : Michael Owens

It is certified that error appears in the above-identified patent and that said Letters Patent is hereby corrected as shown below:

On the title page, col. 1 after item [87] insert item [30]

Foreign Application Priority Data

Jan. 29, 1992 [AU] Australia ..... PL0590--

Signed and Sealed this

Fifteenth Day of September, 1998

*Attest:*

*Attesting Officer*

BRUCE LEHMAN

*Commissioner of Patents and Trademarks*